US008653353B2

(12) United States Patent
Komatsu

(10) Patent No.: US 8,653,353 B2
(45) Date of Patent: Feb. 18, 2014

(54) ELECTRONIC KEYBOARD MUSICAL INSTRUMENT

(71) Applicant: Akihiko Komatsu, Hamamatsu (JP)

(72) Inventor: Akihiko Komatsu, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/622,562

(22) Filed: Sep. 19, 2012

(65) Prior Publication Data

US 2013/0068084 A1 Mar. 21, 2013

(30) Foreign Application Priority Data

Sep. 20, 2011 (JP) ..... 2011-204468

(51) Int. Cl.
*G10H 1/34* (2006.01)

(52) U.S. Cl.
USPC ..... 84/627; 84/615; 84/644; 84/653; 84/658; 84/663

(58) Field of Classification Search
USPC ..... 84/615, 627, 644, 653, 658, 663
See application file for complete search history.

(56) References Cited

U.S. PATENT DOCUMENTS

| | | | | |
|---|---|---|---|---|
| 4,493,237 | A * | 1/1985 | DeLong et al. | 84/626 |
| 5,652,399 | A * | 7/1997 | Fujiwara et al. | 84/21 |
| 6,407,326 | B1 * | 6/2002 | Kondo | 84/615 |
| 6,765,142 | B2 * | 7/2004 | Sakurada et al. | 84/719 |
| 8,053,658 | B2 * | 11/2011 | Tanaka et al. | 84/604 |
| 2002/0046640 | A1 * | 4/2002 | Kondo | 84/615 |
| 2003/0131720 | A1 * | 7/2003 | Sakurada et al. | 84/719 |
| 2003/0188627 | A1 * | 10/2003 | Longo | 84/627 |
| 2005/0092164 | A1 * | 5/2005 | Fujiwara et al. | 84/645 |
| 2006/0201313 | A1 * | 9/2006 | Sasaki et al. | 84/626 |
| 2007/0221036 | A1 * | 9/2007 | Fujiwara | 84/21 |
| 2008/0127807 | A1 * | 6/2008 | Yamaguchi | 84/436 |
| 2008/0168892 | A1 * | 7/2008 | Uehara | 84/610 |
| 2009/0084248 | A1 * | 4/2009 | Furukawa et al. | 84/609 |
| 2010/0229707 | A1 * | 9/2010 | Sasaki | 84/20 |
| 2011/0185876 | A1 * | 8/2011 | Fujiwara et al. | 84/21 |
| 2013/0068084 | A1 * | 3/2013 | Komatsu | 84/622 |
| 2013/0239786 | A1 * | 9/2013 | Sakata | 84/626 |

FOREIGN PATENT DOCUMENTS

JP 2008-070895 A 3/2008

* cited by examiner

*Primary Examiner* — David S. Warren
(74) *Attorney, Agent, or Firm* — Rossi, Kimms & McDowell LLP

(57) ABSTRACT

An electronic keyboard musical instrument, including: a key; a mass body driven by a depressed key for pivotally moving in a movement region between a rest position and an end position; a back check portion to back check the mass body; a position detecting portion to detect a position of the mass body; and a controller for controlling silencing of a tone, such that the currently generated tone is silenced when the mass body reaches a preset tone silencing position in its movement from the end position to the rest position, wherein the controller is configured to change the tone silencing position on the basis of respective times required for the mass body to pass through first and second sub regions of the movement region in the movement of the mass body, the second sub region being located nearer to the rest position than the first sub region.

9 Claims, 4 Drawing Sheets

ELECTRONIC KEYBOARD MUSICAL INSTRUMENT

CROSS REFERENCE TO RELATED APPLICATION

The present application claims priority from Japanese Patent Application No. 2011-204468 which was filed on Sep. 20, 2011, the disclosure of which is herein incorporated by reference in its entirety.

BACKGROUND OF THE INVENTION

1. Field of the Invention

The present invention relates to an electronic keyboard musical instrument configured to execute a tone generation control using position information of a mass body.

2. Description of Related Art

In an electronic keyboard musical instrument using an action mechanism, there is conventionally known the one configured to execute a musical tone control utilizing position information of a key. For performing a more real musical tone control, there is known the one that utilizes position information of a mass body (hammer), as disclosed in the following Patent Literature 1.

In the musical instrument disclosed in the Patent Literature 1, positions of the hammer including a back checking start position at which the hammer starts to be back checked and a back checking end position at which the hammer is released from a back checked state are successively obtained and are utilized in the control.

Patent Literature 1: JP-A-2008-70895

SUMMARY OF THE INVENTION

In the musical instrument disclosed in the Patent Literature 1, however, the control is performed on the condition that the back checking works or acts. Further, in the disclosed musical instrument, a relationship between the back checking and timing of tone silencing is not clear.

In general, the back checking does not always work. More specifically, the state of back checking (effective or non-effective) and the degree of action of back checking vary depending upon a key depression strength (key depression velocity) and a key release strength (key release velocity). Therefore, where the control is uniformly performed, appropriate tone silencing cannot be performed. In particular, in some instances, tone silencing is performed at inappropriate timing.

In an instance in which back checking works to a significant or sufficient extent, such as an instance in which a key is depressed at a medium depression velocity such as mezzo forte or mezzo piano and the key is then released slowly, the hammer tends to return slowly. In such an instance, where a tone is controlled to be silenced at a uniform or constant tone silencing position, a performer of the musical instrument may feel that tone silencing is delayed and may have an awkward or unnatural feeling as compared with an acoustic piano. Accordingly, there is room for improvement in the tone silencing control in accordance with the state of back checking, for attaining a more delicate musical tone control.

The present invention has been developed to solve the conventionally experienced problems described above and provides an electronic keyboard musical instrument capable of rendering tone silencing timing close or similar to natural one while taking the state of back checking into account.

More specifically, the present invention provides an electronic keyboard musical instrument, comprising:

a key (24) to be depressed and released;

a mass body (HM) provided for the key and configured to be driven by a depressing operation of the key so as to pivotally move in a movement region between a rest position and an end position;

a back check portion (34, 44) configured to back check the mass body which moves from the end position to the rest position;

a position detecting portion (41) configured to detect a position of the mass body; and a controller (11) configured to generate a musical tone in accordance with the depression operation of the key and configured to control silencing of the musical tone on the basis of the position of the mass body detected by the position detecting portion, such that the musical tone that is being generated for the key which corresponds to the mass body is silenced when the mass body reaches a preset tone silencing position (KH1) in a movement of the mass body from the end position to the rest position, wherein the controller is configured to change the tone silencing position on the basis of a time (TA) required for the mass body to pass through a first sub region (RA) of the movement region and a time (TB) required for the mass body to pass through a second sub region (RB) of the movement region in the movement of the mass body from the end position to the rest position, the second sub region being located nearer to the rest position than the first sub region.

The reference signs in the brackets attached to respective constituent elements in the above description correspond to reference signs used in the following embodiment to identify the respective constituent elements. The reference sign attached to each constituent element indicates a correspondence between each element and its one example, and each element is not limited to the one example.

BRIEF DESCRIPTION OF THE DRAWINGS

The above and other objects, features, advantages and technical and industrial significance of the invention will be better understood by reading the following detailed description of an embodiment of the invention, when considered in connection with the accompanying drawings, in which.

DETAILED DESCRIPTION OF THE EMBODIMENT

Hereinafter, there will be explained one embodiment of the invention with reference to the drawings.

Figure 1:
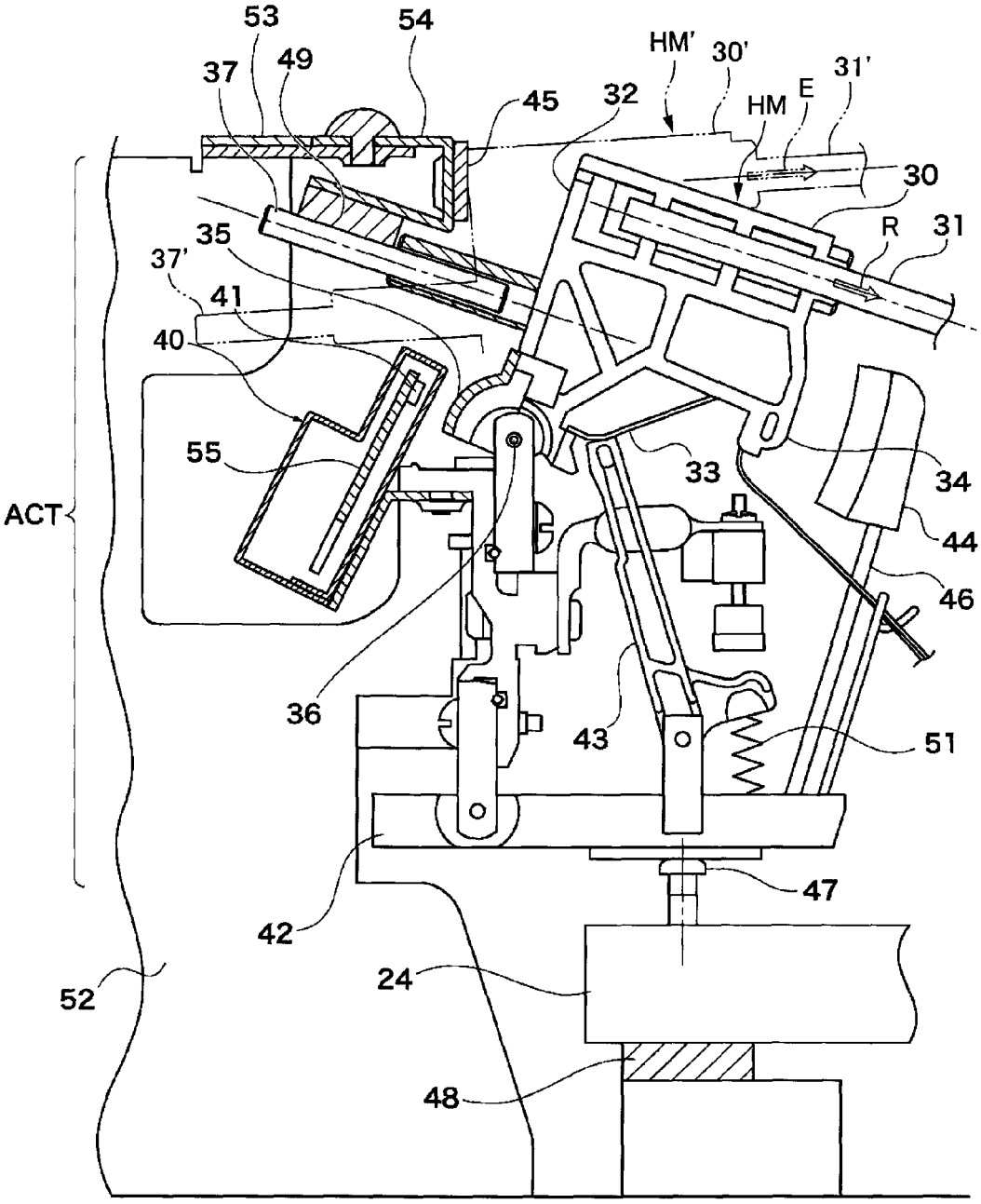
FIG. 1 is a vertical sectional view showing a rear portion (a principal portion of a keyboard structural portion) of an electronic keyboard musical instrument according to one embodiment of the invention.

In the vertical sectional view of FIG. 1 showing a rear portion (a principal portion of a keyboard structural portion) of an electronic keyboard musical instrument according to one embodiment of the invention, one key 24 and an action mechanism ACT corresponding to the key 24 are particularly shown.

In the electronic keyboard musical instrument, a plurality of keys 24 (white keys and black keys) are arranged in parallel with each other. Each key 24 is disposed so as to be pivotable clockwise and counterclockwise in FIG. 1 about a key fulcrum (not shown). The right-hand side in FIG. 1 corresponds to a performer's side and a front side while the left-hand side in FIG. 1 is a rear side. A front portion (not illustrated in FIG. 1) of the key 24 is depressed and released. The action mechanism ACT is provided above a rear end portion of each key 24.

The action mechanism ACT mainly includes a whippen 42, a hammer HM which is a hammer assembly and which is a mass body, and a jack 43. The whippen 42 is configured to be driven so as to be pushed up by an associated key 24. A jack 43 is supported by the whippen 42 via a jack flange so as to be pivotable clockwise and counterclockwise in FIG. 1.

A back check wire (BC rod) 46 is provided at a front end portion (free end portion) of the whippen 42 so as to be inclined forward. At an upper end of the back check wire 46, there is provided a back check 44 for elastically receiving a catcher 34 of the hammer HM. The catcher 34 and the back check 44 constitute a back check portion.

The hammer HM mainly includes a butt 30 and a hammer shank 31. The butt 30 is provided so as to be pivotable clockwise and counterclockwise in FIG. 1 about a hammer pivot shaft 36. In a non-key depression state shown in FIG. 1, the hammer HM undergoes a force in a clockwise direction in FIG. 1 by its own weight.

In the non-key depression state, the rear end portion of the key 24 is in contact with a key stopper 48 so as to define an initial position of the key 24 while the whippen 42 is in contact with a capstan portion 47 so as to define an initial position of the whippen 42. An initial position of the hammer HM is defined by a contact of a backward extending portion 37 of the hammer HM with a stopper 49. At the initial position of the hammer HM, the jack 43 receives a force in a counterclockwise direction from a spring 51 such that a struck portion 33 of the hammer HM is in contact with an upper end of the jack 43.

Figure 2:
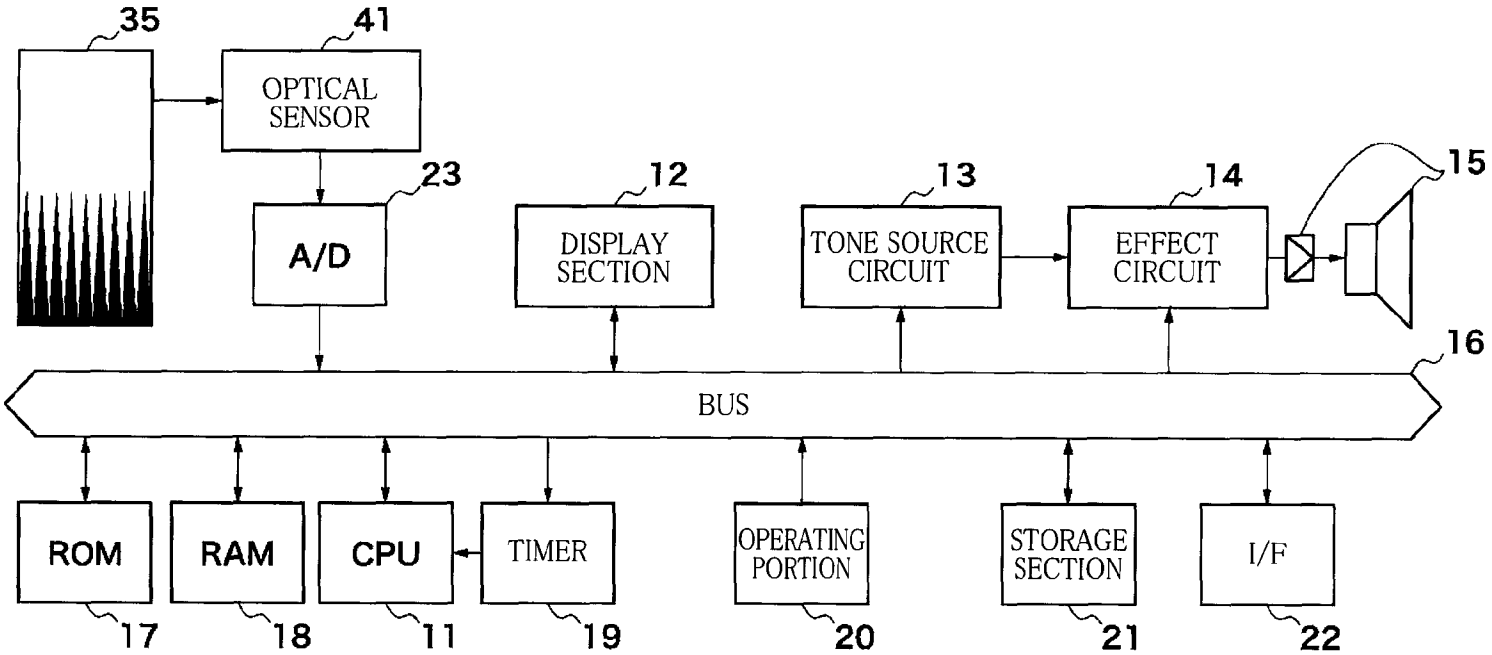
FIG. 2 is a block diagram showing an overall structure of the electronic keyboard musical instrument.

A sensor unit 40 is fixedly disposed with respect to the present musical instrument via an attachment member 52. An optical sensor 41 is provided on a sensor board 55 in the sensor unit 40. The optical sensor 41 is provided for each of the keys 24. On the other hand, at a lower rear portion of the butt 30 of the hammer HM, a reflection surface 35 is provided so as to be opposed to the optical sensor 41. On the reflection surface 35, a gray (black and white) scale (not shown) is formed. In the gray scale, a plurality of black color portions each having an isosceles triangular shape that is upwardly convex are arranged in parallel with each other on a white color surface, as shown in FIG. 2.

The optical sensor 41 is configured to output a signal in accordance with an amount of light reflected by the reflection surface 35. A pattern shown in FIG. 2 is formed on the reflection surface 35 such that the amount of the reflected light on the reflection surface 35 successively changes, namely, increases or decreases, as the hammer HM pivots counterclockwise in FIG. 1 from the initial position by being driven by a depressing operation of the associated key 24. Accordingly, the optical sensor 41 is configured to successively detect a pivot position of the hammer HM by the amount of the reflected light and functions as a position detecting portion. The position detection by the optical sensor 41 has a linear characteristic. The optical sensor 41 may be replaced with any other sensors as long as the sensors are capable of detecting the position of the hammer HM. For instance, there may be employed, other than the optical sensor, a detecting mechanism such as a magnetic pattern detector.

An upper-limit stopper 45 for the hammer HM is fixedly disposed with respect to the present musical instrument via an upper bent portion 53 of the attachment member 52 and an attachment piece 54 fixed to the upper bent portion 53. A limit position of the hammer HM in a pivot direction corresponding to a key depression direction is defined by a contact of an abutment portion 32 of the butt 30 with the upper-limit stopper 45. A limit position of the key 24 in the key depression direction is defined by a contact of the front portion of the key 24 with a key depression stopper (not shown) provided below the front portion of the key 24.

However, when a key depression force with which the key 24 is depressed is strong, namely, the key depression force is equal to or greater than a force causing a pianissimo sound, the hammer HM slightly returns in a return direction toward the initial position after the contact of the abutment portion 32 and the upper-limit stopper 45. In a state in which the key 24 is kept depressed, the catcher 34 is received by the back check 44 to establish a back checking state, and the back checking state is maintained. In a rapid rendition of a passage or successive (repeated) weak key depressions, there may be cases in which the abutment portion 32 does not come into contact with the upper-limit stopper 45 and the hammer HM returns to the initial position shown in FIG. 1 without the abutment portion 32 and the upper-limit stopper 45 coming into contact with each other and without the hammer HM being back checked.

In the following explanation, directions of a pivotal movement of each of the key 24 and the hammer HM are referred to as follows. For each of the key 24 and the hammer HM, the position (FIG. 1) in the non-key depression state corresponds to an initial position. A direction in which each of the key 24 and the hammer HM pivots from the initial position in a key depression forward stroke corresponds to a forward direction of the pivotal movement of each of the key 24 and the hammer HM. A direction in which each of the key 24 and the hammer HM returns to the initial position corresponds to a reverse direction in the pivotal movement of each of the key 24 and the hammer HM.

Here, the position of the key 24 in the initial state shown in FIG. 1 is referred to as a rest position of the key 24. The position of the hammer HM in the initial state shown in FIG. 1 is referred to as a rest position of the hammer HM. The rest position of the key 24 is a position of the key 24 in the non-key depression state. The rest position of the hammer HM is a position of the hammer HM in the non-key depression state. Further, an end position of the pivotal movement in the forward direction of the key 24 is referred to as an end position of the key 24, and an end position of the pivotal movement in the forward direction of the hammer HM is referred to as an end position of the hammer HM. In other words, the end position of the hammer HM is a position of the hammer HM at a time when the abutment portion 32 of the butt 30 comes into contact with the upper-limit stopper 45 and is a limit pivot position of the hammer HM in the forward direction (i.e., a position of the hammer HM at a time when the hammer HM pivots to the largest extent in the forward direction).

The structure of the electronic keyboard musical instrument when the hammer HM is located at the rest position and at the end position will be explained. In FIG. 1, the hammer HM located at the rest position is illustrated by the solid line while the hammer HM' located at the end position is illustrated by the long dashed double-short dashed line. That is, the butt 30' of the hammer HM' located at the end position is in contact with the upper-limit stopper 45, and respective positions of the hammer shank 31' and the backward extending portion 37' of the hammer HM' located at the end position are defined on the basis of the position of the butt 30' which is in contact with the upper-limit stopper 45. For components of the electronic keyboard musical instrument other than the hammer HM, positions of the respective components when the hammer HM is located at the rest position are illustrated by the solid line.

In the present embodiment, the longitudinal direction of the hammer HM is made equal to the same direction as the axial direction of the hammer shank 31 indicated by the long dashed short dashed line in FIG. 1. A vector that extends in the longitudinal direction is referred to as an axial vector. The scalar of this axial vector is maximum (e.g., equal to scalar corresponding to 1) when the longitudinal direction of the hammer HM coincides with the horizontal direction. The scalar of the axial vector becomes smaller as the longitudinal direction of the hammer HM approaches the vertical direction and is minimum (e.g., equal to scalar corresponding to 0) when the longitudinal direction of the hammer HM coincides with the vertical direction. The axial vector at a time when the hammer HM is located at the rest position is indicated by "R" in FIG. 1 while the axial vector at a time when the hammer HM is located at the end position is indicated by "E" in FIG. 1. The longitudinal direction of the hammer HM and the axial direction of the hammer shank 31 need not necessarily coincide with each other.

Where the axial vector of the hammer HM is defined as described above, the scalar of the axial vector when the hammer HM is located at the end position is substantially maximum (e.g., equal to scalar corresponding to substantially 1) as shown in FIG. 1, and the scalar of the axial vector when the hammer HM is located at the rest position is smaller than that when the hammer HM is located at the end position. This indicates that the longitudinal direction of the hammer HM when the hammer HM is located at the end position is closer to the horizontal direction than the longitudinal direction of the hammer HM when the hammer HM is located at the rest position. In the electronic keyboard musical instrument according to the present embodiment, the longitudinal direction of the hammer HM (i.e., the direction of the axial vector) when the hammer HM is located at the end position is substantially parallel to the horizontal direction. "The longitudinal direction of the hammer HM is substantially parallel to the horizontal direction" means that an angle formed by the longitudinal direction of the hammer HM and the horizontal direction on the vertical plane is held within a range of 0°-20°. In other words, an angle of the longitudinal direction of the hammer HM with respect to the horizontal direction on the vertical plane is not smaller than 0° and not large than 20° in the vertically upward direction or in the vertically downward direction.

In the electronic keyboard musical instrument constructed as described above, the longitudinal direction of the hammer HM when the hammer HM is located at the end position substantially coincides with the horizontal direction, and therefore the structure of the hammer HM in the present embodiment is similar to that of a hammer in an action mechanism of a grand piano. However, the action mechanism ACT in the electronic keyboard musical instrument according to the present embodiment is similar to that of an upright piano. Accordingly, it is possible to enhance manufacturing efficiency by reducing differences in construction between the grand piano and the upright piano while enjoying constructional advantages of the grand piano. Although a delay of tone silencing timing described below may occur due to employment of the structure described above in the present embodiment, the delay of tone silencing timing is eliminated in the present embodiment owing to a later explained algorithm by a CPU 11.

The axial vector of the hammer HM is defined as described above. However, the axial vector of the hammer HM is actually a vector whose start point coincides with the center of gravity of the hammer HM and which extends in a direction of a tangent to a pivot locus formed by the center of gravity when the hammer HM pivots about the hammer pivot shaft 36. The scalar of this vector is maximum (e.g., equal to scalar corresponding to 1) when the axial vector extends in the horizontal direction and is minimum (e.g., equal to scalar corresponding to 0) when the axial vector extends in the vertical direction. Since the direction of the axial vector substantially coincides with the longitudinal direction of the hammer HM, the axial vector is explained as described above for the sake of convenience.

The motion of the action mechanism ACT constructed as described above will be explained. When the key 24 is depressed from the non-key depression state, the capstan portion 47 located on the rear end portion of the key 24 pushes up the whippen 42, whereby the jack 43 moves upward so as to push up the struck portion 33 of the butt 30. As a result, the hammer HM pivots in the forward direction (counterclockwise) about the hammer pivot shaft 36.

Subsequently, the jack 43 pivots clockwise, and the upper end portion of the jack 43 removes away from the struck portion 33 of the butt 30 so as to escape therefrom. When the key 24 is depressed with an ordinary or medium force (ordinary or medium depression) or depressed with a strong force (strong depression), the hammer HM freely pivots after the escapement, and the abutment portion 32 comes into contact with the upper-limit stopper 45 and then is rebounded therefrom. When the key is depressed with a weak force (weak depression) whose magnitude is smaller than a specific or certain magnitude, however, the hammer HM does not come into contact with the upper-limit stopper 45.

When the hammer HM pivots in the reverse direction after the escapement, the catcher 34 of the hammer HM is elastically received by the back check 44, so that the back checking state is established. As long as the key depression state is maintained, the entirety of the action mechanism ACT is stabilized in that posture.

The motion of the action mechanism ACT from key depression to key release is diverse, and the behavior of the hammer HM varies depending upon a key depression velocity and a key release velocity. There may be an instance in which the hammer HM returns to the rest position without being back checked. Further, there may be an instance in which, in spite of the back checking state, the catcher 34 comes into contact with the back check 44 but fails to be stopped by the back check 44, and the catcher 34 slides on the back check 44 and the hammer HM immediately returns to the rest position.

Depending upon the state of back checking, the speed of returning of the hammer HM thereafter is changed. In general, the silencing of the musical tone is performed at timing when the hammer HM returns to a prescribed position. Accordingly, where the return speed of the hammer HM is changed, the tone silencing timing is particularly influenced. In view of this, in the present embodiment, the tone silencing timing is switched or changed while considering the state of back checking.

FIG. 2 is a block diagram showing an overall structure of the electronic keyboard musical instrument.

The musical instrument of the present embodiment is constituted such that a ROM 17, a RAM 18, a timer 19, an operating portion 20, a storage section 21, various interfaces (I/F) 22, an A/D converting section 23, a display section 12, a tone source circuit 13, and an effect circuit 14 are connected to the CPU 11 via a bus 16. The timer 19 is connected to the CPU 11, and a sound system 15 is connected to the tone source circuit 13 via the effect circuit 14.

An analog signal from the optical sensor 41 is converted into a digital detection signal in the A/D converting section 23 and is supplied to the CPU 11. The CPU 11 controls the musical instrument as a whole. The ROM 17 stores various programs to be executed by the CPU 11 and various table data. The RAM 18 temporarily stores performance data, various flags, buffer data, computation results, etc. The timer 19 measures an interrupt time in timer interrupt processing and various times. The storage section 21 stores various application programs including the control programs described above, various music data, various data, etc.

The tone source circuit 13 converts, into a musical tone signal, performance data based on the detection signal from the A/D converting section 23, pre-set performance data, etc. The effect circuit 14 gives various effects to the musical tone signal inputted from the tone source circuit 13. The sound system 15 converts the musical tone signal or the like inputted from the effect circuit 14, into an acoustic sound.

Figure 3:
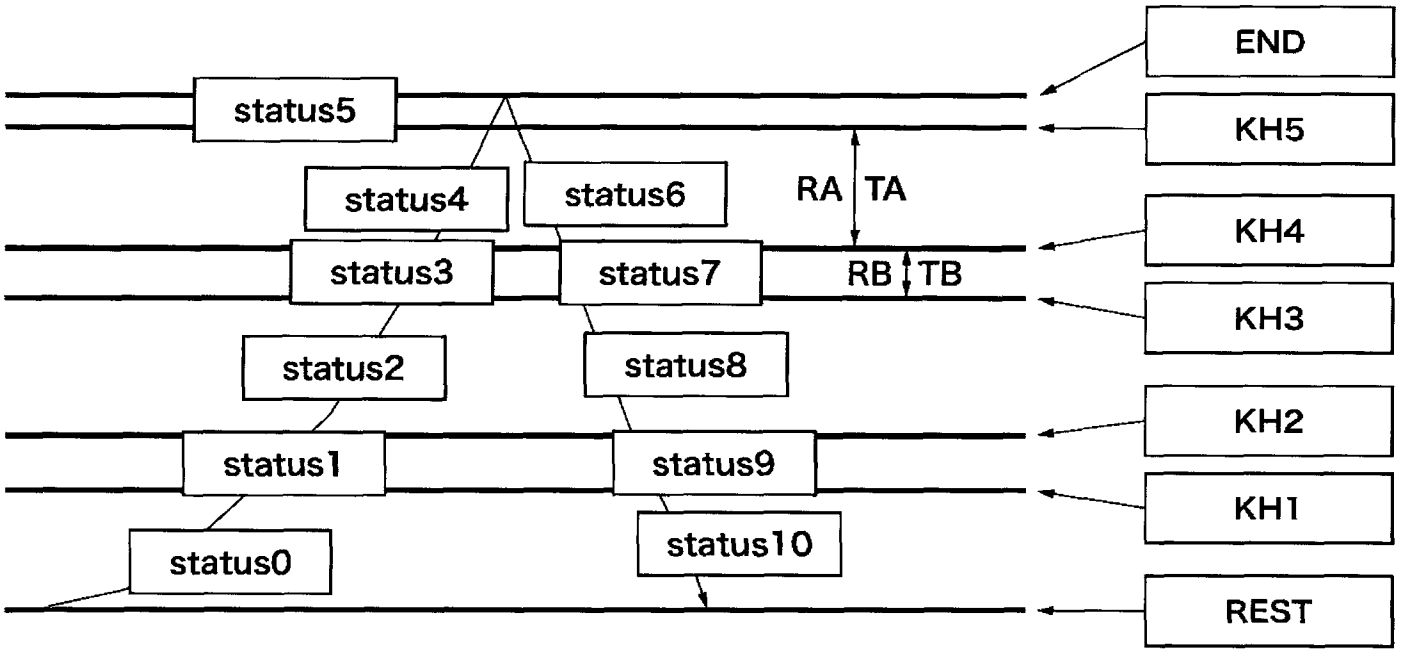
FIG. 3 is a conceptual view showing a relationship between a movement region and a status of a hammer.

FIG. 3 is a conceptual view showing a relationship between a movement region and a status of the hammer HM.

In the present embodiment, not the position of each key 24 but the position of each hammer HM is detected by the corresponding optical sensor 41, and there is executed a control of generation and silencing of a musical tone for each key 24 on the basis of the detection result. The concept shown in FIG. 3 is common to all of the hammers HM. The upward direction in FIG. 3 corresponds to the forward direction.

The movement region in which the hammer HM pivotally moves is a stroke from the rest position (REST) to the end position (END). This movement region is divided into a plurality of (six) sub regions. Positions KH corresponding to boundaries of the respective sub regions include a position KH1, a position KH2, a position KH3, a position KH4, and a position KH5 arranged in the order of description from a side nearer to the rest position (a shallower side of the stroke), namely, from the lower side in FIG. 3. The CPU 11 judges, on the basis of a change of the detection signal of the optical sensor 41, in which one of the forward direction and the reverse direction the hammer HM has passed the boundary of each sub region, whereby a current status of the hammer HM is defined. The status of the hammer HM is represented by numbers from "0" to "10". The status may be represented as "ST".

When the key 24 is slightly depressed from the non-key depression state, for instance, the status of the hammer HM becomes the status 0. Where the hammer HM crosses the position KH1 in the forward direction of the key depression, the status becomes the status 1. Where the hammer HM crosses the position KH2 in the forward direction when the hammer is in the status 1, the status becomes the status 2. On the other hand, where the hammer HM crosses the position KH1 in the reverse direction when the hammer is in the status 1, the status becomes the status 10, not the status 0. Accordingly, each of the status 0, the status 1, the status 2, the status 3, the status 4, and the status 5 is a status which is established when the hammer HM has crossed each position KH in the forward direction while each of the status 6, the status 7, the status 8, the status 9, and the status 10 is a state which is established when the hammer HM has crossed each position KH in the reverse direction. Information as to the status is stored in the RAM 18 and is successively updated.

Basically, in the present embodiment, generation of a musical tone having a pitch of the associated key 24 is initiated when the hammer HM passes, in the forward direction, a tone generating position (set at the position KH5, for instance). The musical tone that is being generated is silenced or stopped when the hammer HM passes, in the reverse direction, the position KH1 which is a pre-set tone silencing position. However, where a prescribed condition is satisfied, namely, where an affirmative decision YES is made in step S108 in the flow chart of FIG. 4 which will be explained, the tone silencing position is changed from the position KH1 to the position KH3.

The tone silencing corresponds to initiation of release of the generated musical tone. The position KH5 is a position which is distant from the rest position, namely, which is distant from the shallower side in the stroke, by a distance corresponding to 95% of the entire stroke, for instance. The position KH1 and the position KH3 are positions which are distant from the rest position, namely, which are distant from the shallower side in the stroke, by a distance corresponding to 45% of the entire stroke and a distance corresponding to 60% of the entire stroke, respectively. However, those distances are examples and may be changed depending upon types or models of the musical instrument and may be variable.

Figure 4:
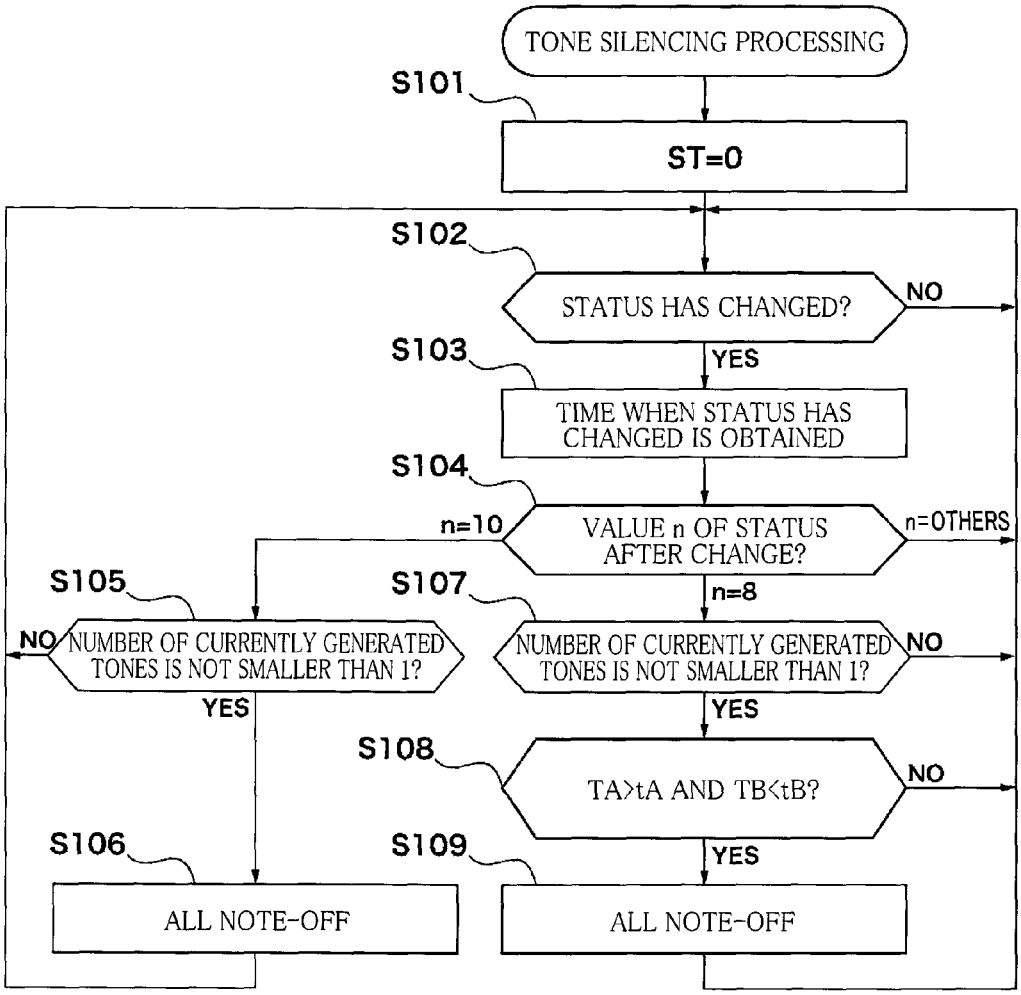
FIG. 4 is a flow chart showing tone silencing processing.

The flow chart of FIG. 4 shows tone silencing processing.

The tone silencing processing is executed by the CPU 11 as a part of processing for ordinary performance, namely, a part of processing for real-time performance. In the real-time performance processing, tone generation processing is executed separately from the tone silencing processing. That is, there are detected, by the optical sensor 41, a key code (tone pitch information), a velocity (tone volume information), and a note-on operation corresponding to a depressed key 24, via the hammer HM. The detection signal is sent to the tone source circuit 13, and a musical tone of the designated timbre is reproduced. The tone silencing processing of FIG. 4 is executed for each key 24 concurrently with the tone generation processing described above.

Initially, in step S101, it is judged whether the status is the status ST=0 (status 0) or not. It is then judged in step S102 whether the status has changed or not. Where the status has changed, a time when the status has changed is obtained. (step S103). This time is used for measuring a duration of time during which each status is kept established. In the time measuring, the timer 19 and the CPU 11 cooperate to execute timer interrupt processing (not shown).

Subsequently, in step S104, the processing is branched depending upon a value n of the changed status ST. Where the value n is other than 8 (ST=8) and 10 (ST=10), the flow goes back to step S102. That is, the tone silencing processing is not implemented. Where the value n is equal to 10 (ST=10), it means that the hammer HM has currently passed, in the reverse direction, the position KH1 which is the pre-set tone silencing position. Accordingly, the flow goes to step S105 in which it is judged whether or not the number of currently generated tones at a pitch corresponding to the depressed key 24 is not smaller than 1.

Where the number of currently generated tones is 0, the flow goes back to step S102. Where the number of currently generated tones is not smaller than 1, all of the same notes that are currently being generated are controlled to be silenced, i.e., issuance of note-off, (step S106). In other words, where the key 24 is successively or repeatedly depressed without returning the key 24 to the rest position, for instance, two or more of the note-ons at the same pitch may be rising. In this instance, all of the note-ons are silenced or stopped at a time. After step S106, the flow goes back to the processing in S102.

Where it is judged in step S104 that the value n is equal to 8 (ST=8), it means that the hammer HM has currently passed the position KH3 in the reverse direction. Accordingly, the flow goes to step S107 in which it is judged whether or not the number of currently generated tones at a pitch corresponding to the depressed key 24 is not smaller than 1. Where the number of currently generated tones is 0, the flow goes back to step S102. Where the number of currently generated tones is not smaller than 1, the flow goes to step S108.

As shown in FIG. 3, a sub region between the position KH5 and the position KH4 is referred to as a first sub region RA while a sub region between the position KH4 and the position KH3 is referred to as a second sub region RB. The second sub region RB is a region which is located one of opposite sides of the first sub region RA nearer to the rest position, so as to be adjacent to the first sub region RA. In particular, in at least a part of the first sub region RA, the hammer HM can be back checked. In a movement of the hammer HM from the end position to the rest position, a time required for the hammer HM to pass through the first sub region RA is referred to as a time TA while a time required for the hammer HM to pass through the second sub region RB is referred to as a time TB.

In step S108 of FIG. 4, it is judged whether the following condition TA>tA is established by comparing the above-indicated time TA with a prescribed first value tA, in the movement of the hammer HM in the reverse direction. Further, in step S108, it is judged whether the following condition TB<tB is established by comparing the above-indicated time TB with a prescribed second value tB, in the movement of the hammer HM in the reverse direction.

Where the conditions TA>tA and TB<tB are both satisfied as a result of the comparisons described above, step S109 is implemented to control all of the same notes that are being currently generated to be silenced, i.e., issuance of note-off. This means that the tone silencing is executed immediately after the hammer HM that moves in the reverse direction has passed the position KH3 even if the hammer HM does not reach the position KH1, only when the conditions in step S108 are satisfied. In other words, this means that the tone silencing position is changed from the pre-set tone silencing position KH1 to the position KH3 which is nearer to the end position than the position KH1. This arrangement advances tone silencing timing than usual when focusing on the movement of the hammer HM.

As a situation in which the conditions in step S108 are satisfied, there is considered a situation in which the back checking works to a significant extent, such as an instance wherein a key depressing and releasing operation is made in which the key depressed with an ordinary or medium force (ordinary or medium depression) is released slowly. Where the back checking works to a sufficient extent, static friction strongly acts between the catcher 34 and the back check 44, whereby returning of the hammer HM thereafter to the rest position tends to be delayed, as compared with a case in which the catcher 34 and the back check 44 engages with each other in a sliding state. Therefore, where the tone silencing is executed uniformly at the position KH1, the performer may feel that the timing of tone silencing is delayed. In the present embodiment, however, the tone silencing position is temporarily changed to the position located on a deeper side in the key depression stroke as described above, so that the delay of the tone silencing timing is avoided.

Where the conditions TA>tA and TB<tB are not satisfied in step S108, the flow goes back to step S102 without executing the tone silencing at that time point. After the processing in step S108, the flow goes back to step S102.

According to the present embodiment, the tone silencing timing is appropriately corrected in a situation in which returning of the hammer HM tends to be delayed due to the back checking, thereby rendering the tone silencing timing close or similar to natural one while taking the back checking state into consideration. Here, to "correct the tone silencing timing" means to eliminate lack of sharpness or distinctness that would be caused by a tone silencing control executed in accordance with an actual movement of the hammer HM.

According to the present embodiment, by judging in which one of the forward direction and the reverse direction the hammer HM has passed the boundary of each of the plurality of sub regions, it is possible to obtain the movement direction of the hammer HM and the current position of the hammer HM. Therefore, it is possible to deal with a situation in which the movement direction of the hammer HM changes on the way back toward the rest position, such as a situation in which the key is successively or repeatedly depressed, enabling an appropriate tone silencing control.

The illustrated manner of changing the tone silencing position is one example and is not limited thereto. Further, the tone silencing position may be changed to a position other than the position KH3. For instance, the tone silencing position may be changed to a prescribed position between the position KH3 and the position KH2 where the conditions in step S108 are satisfied.

In the illustrated embodiment, the time TA required for the hammer HM to pass the first sub region RA and the time TB required for the hammer HM to pass the second sub region RB are counted, and the tone silencing timing is changed using the time TA and the time TB. Both of the time TA and the time TB may not be necessarily counted. For instance, only the time TA required for the hammer HM to pass the first sub region RA may be counted, and the back checking state may be obtained using the time TA, so as to change the tone silencing timing. In the arrangement, the tone silencing timing can be advanced, as compared with an arrangement in which the tone silencing timing is changed using both of the time TA and the time TB.

In the illustrated embodiment, the time TA is counted as the time required for the hammer HM to pass the first sub region RA, and the time TB is counted as the time required for the hammer HM to pass the second sub region RB. It is not necessarily needed to count the time required for the hammer HM to pass the entirety of the first sub region RA or the second sub region RB. For instance, where the condition TA>tA is satisfied when the hammer HM is located, in the movement from the end position to the rest position, at a position within the first sub region RA, which position is nearer to the end position than the position KH4 that is one of opposite ends of the first sub region TA that is on the side of the rest position, the tone silencing control may be executed at timing which is earlier than timing when the hammer HM reaches the position KH4, e.g., at timing when the condition TA>tA is satisfied. In this instance, a time during which the hammer HM is kept located in the first sub region RA and which has elapsed before the condition TA>tA is satisfied is counted. The arrangement also ensures an appropriate tone silencing control because the tone silencing timing can be advanced from the timing when the hammer HM is located at the position KH1 to timing when the condition TA>tA is satisfied.

In the judgments in S108 as to the time TA and the time TB, the time TA or the time TB may be compared with not only the single prescribed value to or tB, but also prescribed values set in steps in each of the sub regions RA, RB, whereby the tone silencing position may be changed in steps in accordance with comparison results. That is, the tone silencing position may be variable depending upon the conditions to be satisfied.

The two regions relating to changing of the tone silencing position are not limited to the sub regions RA, RB, in view of application to not only the situation in which the back checking works to a sufficient extent, but also various situations.

In the present embodiment, the sound generation is triggered by the detection signal indicative of the movement of the hammer HM detected by the optical sensor 41. A sensor configured to detect an operation of the key 24 may be provided, and initiation of the tone generation may be triggered by a depressing operation of the key 24 detected by the sensor.

The keyboard structure shown in FIG. 1 is based on a structure that employs a technical concept of a previously filed application by the assignee of the present application, and overcomes disadvantages thereof. The structure shown in FIG. 1 employs a hammer structure close to that of a grand piano (GP) structure while employing the hammer action of the upright piano (UP) structure.

Accordingly, there is ensured an advantage that the height of the keyboard structure can be reduced. However, the upright piano (UP) structure has an intrinsic disadvantage that the capability of successive key striking or depressing is inferior to the grand piano (GP) structure and still suffers from a drawback that mere employment of the structure of FIG. 1 does not realize a quick return mechanism which enables tone regeneration. By employing the algorithm according to the present invention, however, the drawback described above is mitigated.

Therefore, even if a keyboard structure is employed in which a position sensor is provided in the already existing upright piano (UP) structure, instead of the structure of FIG. 1, the tone silencing can be executed at timing earlier than tone silencing timing (release timing) realized by employing the upright piano (UP) structure, by employing the algorithm according to the present invention. Therefore, even if the already existing upright piano (UP) structure is employed, it is possible to ensure a release timing control which is as clear (distinct) as or clearer (more distinct) than that of the grand piano (GP) structure. In other words, the tone silencing timing in the upright piano (UP) structure becomes equal to or earlier than the tone silencing timing in the grand piano (GP) structure. That is, it is possible to ensure a musical tone control in successive key striking or depressing (tone generation→gone silencing→gone generation). The tone silencing is advanced in the processing in steps S104, S107, S108 of FIG. 4, thereby realizing natural release similar or equal to the grand piano (GP) structure. It is possible to physically gain time before tone is regenerated, namely, before the key is subsequently depressed after it has been once depressed in successive key striking or depressing.

Since it is possible to gain time before the tone regeneration as described above, the capstan portion 47 moves downward as the key 24 returns to the initial position and at the same time, the jack 43 also moves downward, so that the jack 43 can get under the struck portion 33 of the butt 30 on the side nearer to the hammer pivot shaft 36, owing to the action of the spring 51. Subsequently, release is initiated immediately before the jack 43 gets under the struck portion 33 of the butt 30, and there is a slight time before the key 24 returns further after initiation of the release. Within this time, preparation of next tone generation (i.e., the jack 43 gets under the struck portion 33 and tone processing upon key release is executed at earlier timing) is enabled. In other words, the tone generation preparation tends to be easily made, thereby making the next tone generation smooth. Accordingly, the volume change in performance is made smooth, and sharpness in performance is improved.

In the present embodiment, the first sub region RA is adjacent to the second sub region RB. The first sub region RA may not be adjacent to the second sub region RB. Another sub region may exist between the first sub region RA and the second sub region RB.

In the illustrated embodiment, the pre-set tone silencing position is the position KH1, and the changed tone silencing position (the tone silencing position after change) is the position KH3 which is located nearer to the end position than the position KH1. The tone silencing position after change may be set to a position which is located nearer to the rest position than the pre-set tone silencing position. In this instance, the pre-set tone silencing position is utilized where the back checking sufficiently works on the hammer HM such as a case in which the key is depressed at a medium depression velocity such as mezzo forte or mezzo piano and the key is then released slowly. In a case other than the above, i.e., in a case in which the key is released quickly, the tone silencing position after change is utilized. Thus, the tone silencing timing is delayed or made later in the case in which the key is released quickly, whereby an appropriate tone silencing control can be executed.

In the first sub region RA that includes, in an entirety or a part thereof, a back checking range (in which the hammer HM can be back checked), the position of the other of the opposite ends that is on the side of the end position is distant from the end position by a specific distance which is not zero, as shown in FIG. 3. Further, in the first sub region RA that includes, in an entirety or a part thereof, the back checking range, the position of the one of the opposite ends that is on the side of the rest position is distant from the rest position by a specific distance which is not zero. Accordingly, it is possible to detect the time TA required by the hammer HM to pass the first sub region RA in the reverse direction, on the basis of a time point when the hammer HM passed the other of the opposite ends of the first sub region RA that is on the side of the end position and a time point when the hammer HM passed the one of the opposite ends of the first sub region RA that is on the side of the rest position. Therefore, the state of back checking can be grasped.

What is claimed is:

1. An electronic keyboard musical instrument, comprising:

a key to be depressed and released;

a mass body provided for the key and configured to be driven by a depressing operation of the key so as to pivotally move in a movement region between a rest position and an end position;

a back check portion configured to back check the mass body which moves from the end position to the rest position;

a position detecting portion configured to detect a position of the mass body; and a controller configured to generate a musical tone in accordance with the depression operation of the key and configured to control silencing of the musical tone on the basis of the position of the mass body detected by the position detecting portion, such that the musical tone that is being generated for the key which corresponds to the mass body is silenced when the mass body reaches a preset tone silencing position in a movement of the mass body from the end position to the rest position, wherein the controller is configured to change the tone silencing position on the basis of a time required for the mass body to pass through a first sub region of the movement region and a time required for the mass body to pass through a second sub region of the movement region in the movement of the mass body from the end position to the rest position, the second sub region being located nearer to the rest position than the first sub region.

2. The electronic keyboard musical instrument according to claim 1, wherein the second sub region is a region which is located nearer to the rest position than the first sub region and which is adjacent to the first sub region.

3. The electronic keyboard musical instrument according to claim 1, wherein the controller is configured to change the tone silencing position such that timing of tone silencing is advanced on the basis of the time required for the mass body to pass through the first sub region and the time required for the mass body to pass through the second sub region in the movement of the mass body from the end position to the rest position.

4. The electronic keyboard musical instrument according to claim 1, wherein a vector that extends in a longitudinal direction of the mass body is an axial vector, and the axial vector is defined such that scalar thereof is maximum when the longitudinal direction of the mass body coincides with a horizontal direction and becomes smaller as the longitudinal direction of the mass body approaches the vertical direction, and wherein each of the key, the mass body, and the back check portion is configured such that the scalar of the axial vector at a time when the mass body is located at the end position is larger than that at a time when the mass body is located at the rest position.

5. The electronic keyboard musical instrument according to claim 1, wherein the controller is configured to change the tone silencing position so as to be set at a position located nearer to the end position than the preset tone silencing position, where the time required for the mass body to pass through the first sub region is longer than a prescribed first value and the time required for the mass body to pass through the second sub region is shorter than a prescribed second value in the movement from the end position to the rest position.

6. The electronic keyboard musical instrument according to claim 1, wherein the mass body is capable of being back checked by the back check portion in at least a part of the first sub region.

7. The electronic keyboard musical instrument according to claim 1, wherein an end portion of the first sub region on a side of the end position is distant from the end position by a specific distance which is not zero, in a direction from the end position to the rest position.

8. The electronic keyboard musical instrument according to claim 1, wherein an end portion of the first sub region on a side of the rest position is distant from the rest position by a specific distance which is not zero, in a direction from the rest position to the end position.

9. The electronic keyboard musical instrument according to claim 1, wherein the controller is configured to obtain a movement direction and a current position of the mass body by judging, on the basis of the position of the mass body detected by the position detecting portion, in which one of a direction from the rest position to the end position and a direction from the end position to the rest position the mass body has passed each of boundaries of a plurality of sub regions which are obtained by dividing the movement region between the rest position and the end position.

* * * * *